United States Patent [19]

Paler et al.

[11] Patent Number: 4,737,123

[45] Date of Patent: Apr. 12, 1988

[54] CONNECTOR ASSEMBLY FOR PACKAGED MICROWAVE INTEGRATED CIRCUITS

[75] Inventors: Monico T. Paler, Hayward; David R. Johnson, Campbell; Paul E. Buchholz, San Rafael; John G. Galli, San Jose, all of Calif.

[73] Assignee: Watkins-Johnson Company, Palo Alto, Calif.

[21] Appl. No.: 38,539

[22] Filed: Apr. 15, 1987

[51] Int. Cl.[4] ..... H01R 13/648

[52] U.S. Cl. ..... 439/607

[58] Field of Search ..... 439/89-91, 439/96, 272-273, 383, 607, 609, 675, 723

[56] References Cited

U.S. PATENT DOCUMENTS

| | | | |
|---|---|---|---|
| 3,088,089 | 4/1963 | Gregoire | 439/272 |
| 3,409,864 | 11/1968 | Hoffman | 439/723 |
| 3,605,076 | 9/1971 | Dozier | 439/723 |
| 4,227,765 | 10/1980 | Neumann et al. | 439/607 |
| 4,349,241 | 9/1982 | Juris et al. | 439/609 |
| 4,426,127 | 1/1984 | Kubota | 439/609 |
| 4,433,889 | 2/1984 | Ratchford et al. | 439/272 |

*Primary Examiner*—John McQuade

*Attorney, Agent, or Firm*—Flehr, Hohbach, Test, Albritton & Herbert

[57] ABSTRACT

A connector for interconnecting packaged microwave integrated circuits having a connector body with a central contact and outwardly extending rims and a disk shaped compression gasket for providing electrical contact between the circuit package and the connector body.

2 Claims, 2 Drawing Sheets

CONNECTOR ASSEMBLY FOR PACKAGED MICROWAVE INTEGRATED CIRCUITS

This invention relates generally to an rf connector assembly for interconnecting microwave integrated circuits of the type which are packaged in a conductive housing.

In the past, packaged microwave integrated circuits have generally been interconnected or coupled by rf coaxial connectors which include male connectors secured to each housing with female couplers. As the frequencies have increased and the package has become smaller and smaller it has become difficult to employ conventional connectors. As a result, the packages have been simplified to include a lead which extends through an insulating bead which forms part of the package housing. Connectors have comprised a central conductor for receiving the lead and an outer conductor. Conductive connecting gaskets provide contact between the outer conductor and the housings. The difficulty with such connectors has been the fact that as temperature varies, metal to metal contact is often lost and coaxial ground return circuit connections (and thus, interface impedances) are intermittent.

The low profile inherent in the connector assembly of the present invention allows the subsystem designer to use relatively simple planar mounting surfaces to mount flatpack microwave integrated circuits. The basic design of the connector assembly guarantees the highest levels of mechanical integrity despite ambient temperature variations while maintaining a fully shielded, constant impedance radio frequency transmission line connection.

The connector assembly is comprised of three parts: an interconnect body (or barrel) and two identical conductive compression gaskets. The compression gaskets serve the function of maintaining coaxial ground return connections between the package and the interconnect body as the subsystem undergoes temperature changes. This is a critical function of any connector when stable high frequency performance is required. The connector assembly can be utilized in the realization of subsystems consisting of an indefinite number of microwave integrated circuits which can be arranged in virtually any planar pattern desired.

It is an object of the present invention to provide an improved low profile rf connector assembly for interconnecting packaged microwave integrated circuits.

It is another object of the present invention to provide an improved rf connector assembly which maintains metallic contact (and thus, constant impedance) between microwave integrated circuit packages with changes in temperature.

It is another object of the present invention to provide a connector assembly which provides consistent connections by limiting the compression of the gaskets during interconnection of MICS.

The foregoing and other objects are achieved by a connector for connecting microwave integrated circuits packaged in conductive housings which includes an interconnect body with a central contact supported in said body by a dielectric sleeve, a cylindrical rim extending outwardly from the two sides of the body a predetermined distance coaxial with the central contact and a disc shaped compression gasket including a first axially outwardly extending flange of a diameter corresponding to the diameter of the cylindrical rim and a second oppositely axially facing flange. The thickness of the gasket and the length of the cylindrical rim selected whereby the gasket maintains competent electrical contact between the integrated circuit packaged housings and the connector body with changes in temperature.

The foregoing and other objects of the invention will be more clearly understood in the following description taken in connection with the accompanying drawings of which:

Figure 1:
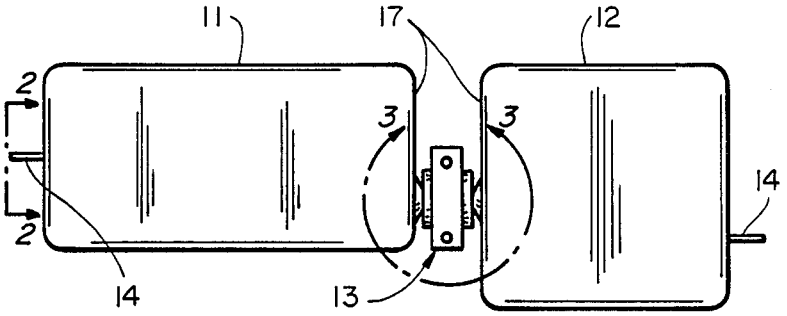
FIG. 1 is a schematic view showing two integrated microwave circuits packaged in housings interconnected by a connector in accordance with the invention.
Figure 2:
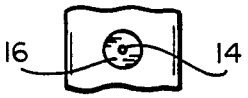
FIG. 2 is a view taken generally along the line 2—2 of FIG. 1.
Figure 3:
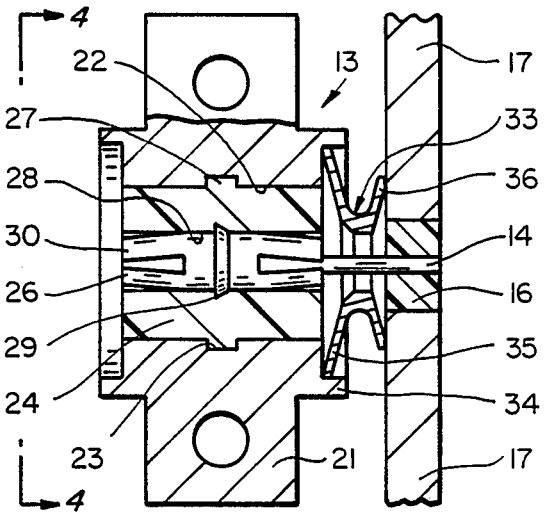
FIG. 3 is an enlarged view of the connector interconnecting the housings taken generally along line 3—3 of FIG. 1.
Figure 4:
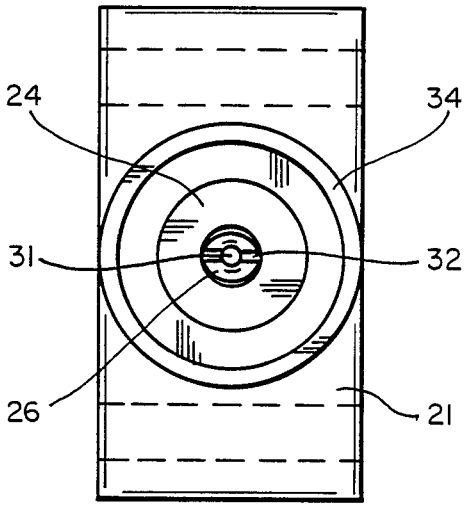
FIG. 4 is an end view of the connector taken along the line 4—4 of FIG. 3.

FIG. 1 shows microwave integrated circuit packages 11 and 12 interconnected by connector 13 in accordance with the invention. The integrated circuit packages include an outward extending lead 14 which connects to the packaged integrated circuits. Lead 14 is supported by an insulating bead 16 which is suitably secured to the housing wall and is sealed to the housing.

In accordance with the invention a connector is provided which provides a connection between the lead 14 of one housing and the corresponding lead 14 of an adjacent housing and also provides competent electrical contact between the housings walls 17.

The connector 13 includes a conductive body 21 which is bored therethrough to provide a hole or opening 22. A circumferential groove 23 is formed intermediate the ends of the hole 22. The body supports a dielectric cylinder 24 which may for example by TFE fluorocarbon which serves to support a center contact 26. More particularly the cylinder 24 is provided with a rim 27. The cylinder 24 is deformed as it is inserted into the hole 22 until the rim 27 snaps into the groove 23 to thereby lock the insulating member in the housing. The cylinder 24 includes a hole 28 with a sawtooth groove 29. The center conductor is formed with a sawtooth rim 30. When the center conductor is forced into the cylindrical member 24 deforms the member to allow the center conductor to be inserted and the sawtooth rim to engage the groove 29. The center conductor is securely held. The ends of the center conductor include a well 31 which is slotted at 32 whereby it can slide onto the conductor 14. The connector body assembly defines a coaxial assembly including an outer conductor, the body, and a center conductor supported coaxially by a dielectric member.

In accordance with the present invention there is provided a conductive compression gasket 33 which rides in the recess defined by the cylindrical rim 34 formed in the body 21. The gasket provides contact between the body 21 and the housing wall 17. The gasket includes a first outwardly and axially extending flange 35 which has a same diameter as the inside diameter of rim 34 and is adapted to fit therein and a second outwardly, axially oppositely extending flange 36 which adapted to ride against the housing surface 17.

The gasket is compressed whereby to give competent electrical contact between the outer surfaces of the two axially and radially extending flange members and the associated body and housing. In accordance with the present invention the extent of the rim 34 and the thickness of the gasket are selected so that during assembly of packages the gasket compression is limited by the rim 34 to assure exact and repeatable compression. This in turn assures competent electrical contact with changes in temperatures whereby to maintain good ground return connections between the connector body and package housings.

Figure 5:
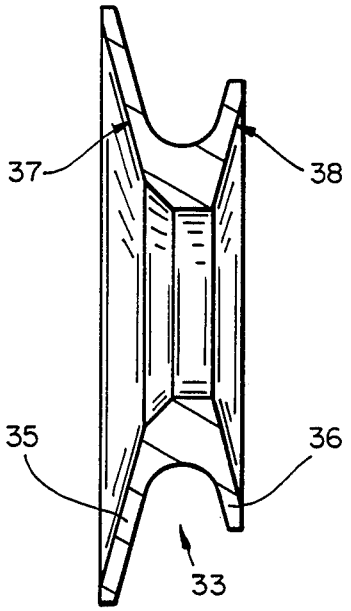
FIG. 5 is an enlarged view of the conductive compression gasket which provides competent electrical contact with changes in temperature.

Referring more particularly to FIG. 5, the maximum permissible deflection of the flange 35 is determined by calculating the deflection which will result in the contact point being at the edge of the dielectric member 24 more particularly the point shown by the arrow 37. Likewise a critical contact point for the contact with the housing is determined as shown by the arrow 38. When the deflection for these two points is known the length of the rim 34 is selected whereby the rim will contact the housing and not permit further compression of the gasket to thereby assure exact, repeatable competent contact with expansion and contraction of the housing and connector body due to changes in ambient temperature.

We claim:

1. A connector for inter-connecting microwave integrated circuit packages of the type which include a housing with a feed-through comprising an insulating bead and a central conductor comprising:

a conductive connector body, a central contact, a dielectric sleeve for supporting the central contact coaxial within the body, a cylindrical rim coaxial with respect to the central contact, extending outwardly from said body a predetermined distance, and a disc shaped gasket including a first outwardly axially extending flange of a diameter corresponding to the diameter of the cylindrical rim and a second oppositely facing outwardly axially extending flange, the thickness of said gasket between opposite extending flanges and the length of the cylindrical rim being selected whereby the gasket maintains competent electrical contact between the integrated circuit package housings and the connector body with changes in temperature.

2. A connector as in claim 1 in which said second outwardly extending flange is of a smaller diameter than the first outwardly extending flange.

* * * * *